US006835118B2

(12) United States Patent
Berkstresser et al.

(10) Patent No.: US 6,835,118 B2
(45) Date of Patent: Dec. 28, 2004

(54) RIGID PLATE ASSEMBLY WITH POLISHING PAD AND METHOD OF USING

(75) Inventors: David Berkstresser, Los Gatos, CA (US); In Kwon Jeong, Sunnyvale, CA (US)

(73) Assignee: Oriol, Inc., Santa Clara, CA (US)

( * ) Notice: Subject to any disclaimer, the term of this patent is extended or adjusted under 35 U.S.C. 154(b) by 122 days.

(21) Appl. No.: 10/014,527

(22) Filed: Dec. 14, 2001

(65) Prior Publication Data

US 2003/0114079 A1 Jun. 19, 2003

(51) Int. Cl.[7] ..... B24D 9/10

(52) U.S. Cl. ..... 451/28; 451/41; 451/57; 451/285; 438/690

(58) Field of Search ..... 451/28, 41, 285–290, 451/57, 58, 397, 364, 398, 388; 156/345; 438/690, 691, 692–693

(56) References Cited

U.S. PATENT DOCUMENTS 5,551,136 A 9/1996 Bartlett ..... 29/239
6,033,293 A 3/2000 Crevasse et al. ..... 451/494
6,050,880 A * 4/2000 Kato et al. ..... 451/41
6,083,083 A * 7/2000 Nishimura ..... 451/41
6,112,740 A * 9/2000 Wark et al. ..... 125/35
6,221,199 B1 4/2001 Chang et al. ..... 156/344
6,244,941 B1 6/2001 Bowman et al. ..... 451/287
6,398,905 B1 * 6/2002 Ward ..... 156/345.12
6,629,876 B1 * 10/2003 Park et al. ..... 451/41

* cited by examiner

*Primary Examiner*—Lee D. Wilson
*Assistant Examiner*—Anthony Ojini
(74) *Attorney, Agent, or Firm*—McKenna Long & Aldridge LLP

(57) ABSTRACT

An apparatus according to the principles of the present invention includes a rotatable platen, a rigid plate member with a top surface and a bottom surface, includes pin members coupled to the rigid plate member which can be inserted into guide openings positioned within the rotatable platen, and a vacuum channel formed within the platen that enables removable mounting the rigid plate member to a top surface of the rotatable platen. The vacuum channel includes a cavity in the top surface of the platen. The rigid plate member adhesively holds the polishing pad to form a rigid plate assembly. A vacuum source coupled to the vacuum channel can be activated to create a vacuum within the vacuum channel to attract the rigid plate member to the platen. The platen can then used to polish work pieces contacting the polishing pad on the top surface of the rigid plate member.

20 Claims, 5 Drawing Sheets

RIGID PLATE ASSEMBLY WITH POLISHING PAD AND METHOD OF USING

BACKGROUND OF THE INVENTION

1. Field of the Invention

The present invention generally relates to polishing and planarizing work pieces. More particularly, the present invention relates to a method and apparatus for implementing replacement of polishing pads used for polishing and planarizing work pieces.

2. Discussion of the Related Art

Chemical mechanical polishing (CMP) is a well known planarizing method. CMP includes attaching one side of the wafer to be polished to a flat surface of a work piece carrier or chuck and pressing the other side of the work piece against a flat polishing pad. Polishing pads can be made of various materials which are commercially available. Typically, a polishing pad is made of blown polyurethane. The hardness and density of a polishing pad depends on the material that is to be polished. In CMP, a slurry containing a particulate abrasive such as cerium oxide, aluminum oxide, or fumed/precipitated silica is applied to a horizontal polishing pad during polishing to enhance the polishing process.

During polishing or planarization, the work piece is typically pressed against the polishing pad surface as the pad and/or the work piece rotates. In addition, to improve polishing, the wafer or pad can also be oscillated back and forth during polishing. It is well-known that polishing pads tend to wear unevenly during polishing, causing surface irregularities to develop on the pad and on the work piece. To ensure consistent and accurate planarization and polishing of all work pieces, such irregularities should be removed.

Furthermore, polishing pads used in CMP must be replaced periodically to ensure efficient polishing. As shown in FIG. 1, a typical CMP machine includes a polishing pad (10) attached, via adhesive (15), to a rotatable platen (25) positioned on a drive assembly that is disposed within a processing chamber of the CMP machine. During the replacement of such a polishing pad, a technician reaches into the processing chamber, grasps a portion of the polishing pad, and then pulls the polishing pad from the rotatable platen. The used polishing pad is then discarded. The remaining adhesive which fixed the polishing pad to the rotatable platen is then removed. Fresh adhesive is then applied in order to fix a new polishing pad to the rotatable platen.

Since the rotatable platen is typically two to three feet in diameter, it is difficult for a technician to replace a polishing pad while the polishing pad and rotatable platen are within the processing chamber. Accordingly, devices and apparatus for assisting removal and replacement of polishing pads have been conceived. For example, U.S. Pat. No. 5,551,136, issued to Bartlett, can be understood to teach a tool for removing a polishing pad from a rotatable platen. That tool includes a base, a lever member, at least one canted or angled latch pin, a chain having a plurality of links or rings, means for clamping the pad, and stop pins.

U.S. Pat. No. 6,221,199, issued to Chang et al., suggests a tool for removing an adhesively bonded pad from a backing plate. That tool includes a T-shaped removal tool that is rotated such that the adhesive bond between a pad and a backing surface is broken by a shearing force.

Additionally, U.S. Pat. No. 6,244,941, issued to Bowman et al., is understood to disclose a method for removing and replacing polishing pads utilized in CMP. The CMP polishing machine includes a rotatable platen with a top plate member having a top surface and means for removably mounting the top plate member to a top surface of the rotatable platen. The means for removably mounting the top plate member to the top surface of the rotatable platen uses electromagnets embedded within the top surface of the rotatable platen. The top plate member holds the polishing pad, which includes a magnetic material. Accordingly, activating the electromagnets attracts the top plate member to the top surface of the rotatable platen, thereby securing the top plate member against the rotatable platen. Additionally, the electromagnets are beneficially embedded within top surface of rotatable platen.

Finally, U.S. Pat. No. 6,033,293, issued to Crevasse et al., is understood to teach a polishing apparatus that includes a rotatable platen which is made of an upper plate and a lower plate. The upper plate is perforated with vacuum holes which open to a top surface. The lower plate contains vacuum channels that are coupled to the holes in the upper plate. A polishing pad includes an upper layer and a lower layer, wherein the upper layer is made of a material for polishing, while the lower layer is made of a hard material. In operation, the lower layer of the pad is placed in contact with the upper plate of the rotatable platen. A vacuum is created within the vacuum holes and vacuum channels, thereby securing the pad to the rotatable platen.

Although the previously described methods and apparatus for replacing a polishing pad are designed to facilitate replacing a polishing pad, they each require the introduction of a second device having multiple moving parts and/or introduces additional elements and features which may become worn and/or require maintenance. The introduction of such a second apparatus or device in facilitating the replacement of a polishing pad significantly increases the cost of the CMP process as well as the downtime for the CMP equipment. The introduction and installation of complex electromagnets embedded within the rotatable platen significantly increases the cost of the CMP equipment and may protrude from the top surface of the rotatable platen, thereby yielding an inconsistent surface for positioning a top plate member thereon. Furthermore, the introduction of specialized bi-layer pads increases the cost of the CMP apparatus.

Accordingly, there is a need for a simple method and apparatus which facilities the removal and replacement of a CMP polishing pad, so as to decrease down time and increase throughput without significantly increasing the cost, wear, and maintenance of the CMP machine.

SUMMARY OF THE INVENTION

It is therefore a principal object of the present invention to provide a method and apparatus for implementing the removal and replacement of a polishing pad during CMP processing.

It is still another object of the present invention to provide a method and apparatus for removing and replacing a polishing pad utilized in CMP processes which does not involve a significant increase in movable parts, specialized components, cost, and/or functional elements.

In brief, an apparatus according to the principles of the present invention includes a rotatable platen, a rigid plate member with a top surface and a bottom surface, and a vacuum channel that enables removably mounting the rigid plate member to a top surface of the rotatable platen. The vacuum channel is beneficially formed within the rotatable platen and includes a cavity in the top surface of the rotatable platen. The rigid plate member adhesively holds the polishing pad to form a rigid plate assembly. A vacuum source coupled to the vacuum channel can be activated to create a vacuum within the vacuum channel to attract the rigid plate member to the top surface of the rotatable platen. The rotatable platen can then used to polish work pieces contacting the polishing pad on the top surface of the rigid plate member.

In addition, an apparatus according to the principles of the present invention includes pin members coupled to the rigid plate member and which can be inserted into guide openings positioned within the rotatable platen.

The objectives, features and advantages of the present invention will become more apparent to those skilled in the art from the following more detailed description of the invention made in conjunction with the accompanying figures.

BRIEF DESCRIPTION OF THE DRAWINGS

The principles of the present invention will hereinafter be described in conjunction with the appended figures, wherein like numerals denote like elements.

DETAILED DESCRIPTION OF THE INVENTION

Figure 1:
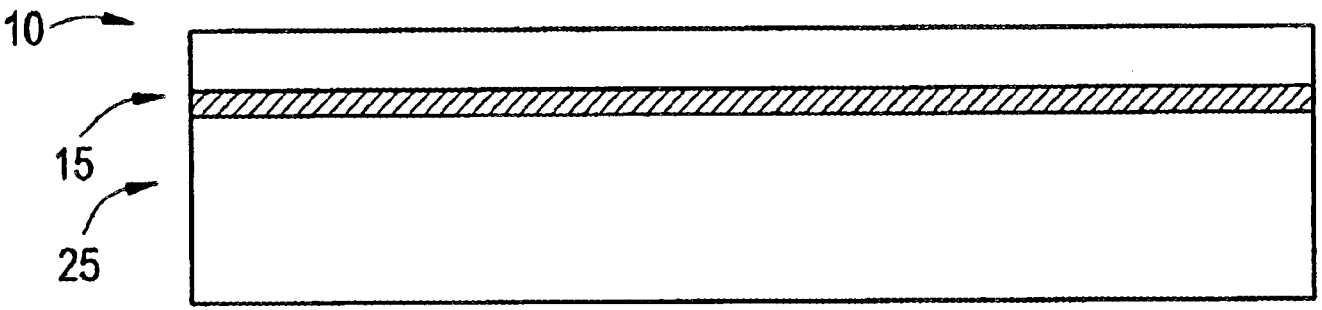
FIG. 1 PRIOR ART
FIG. 1 is schematic view of a polishing pad currently known in the art.
Figure 2:
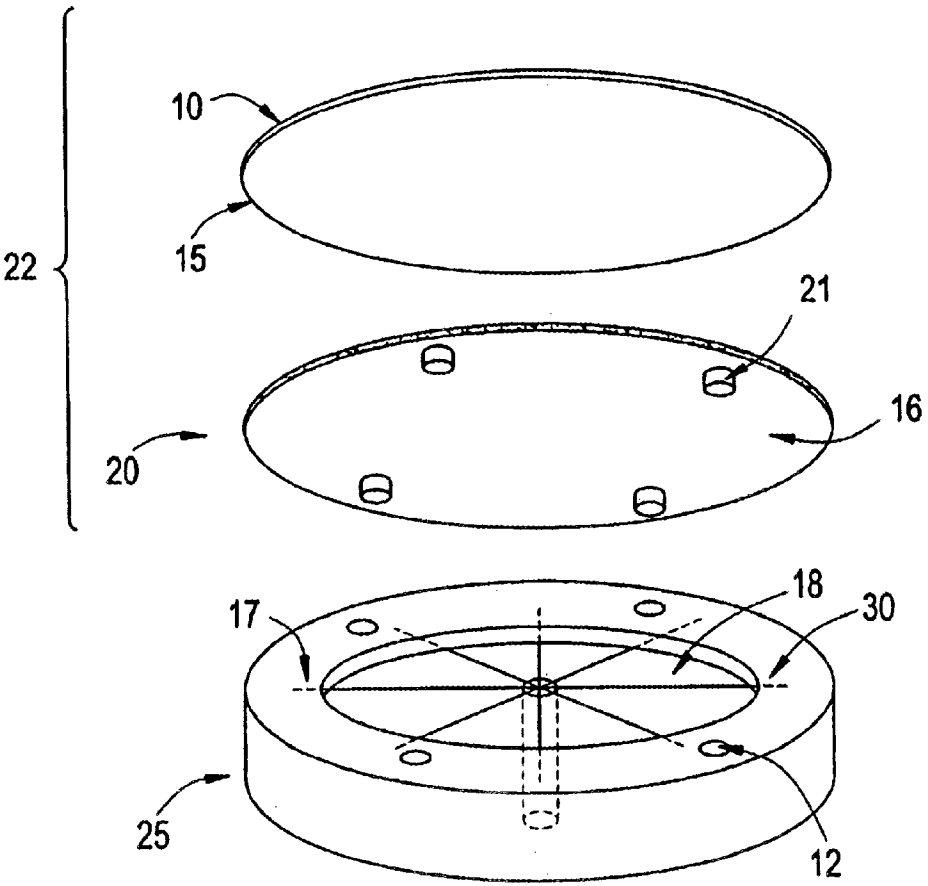
FIG. 2 is a three dimensional blow up view of a rigid plate assembly according to the principles of the present invention.
Figure 3:
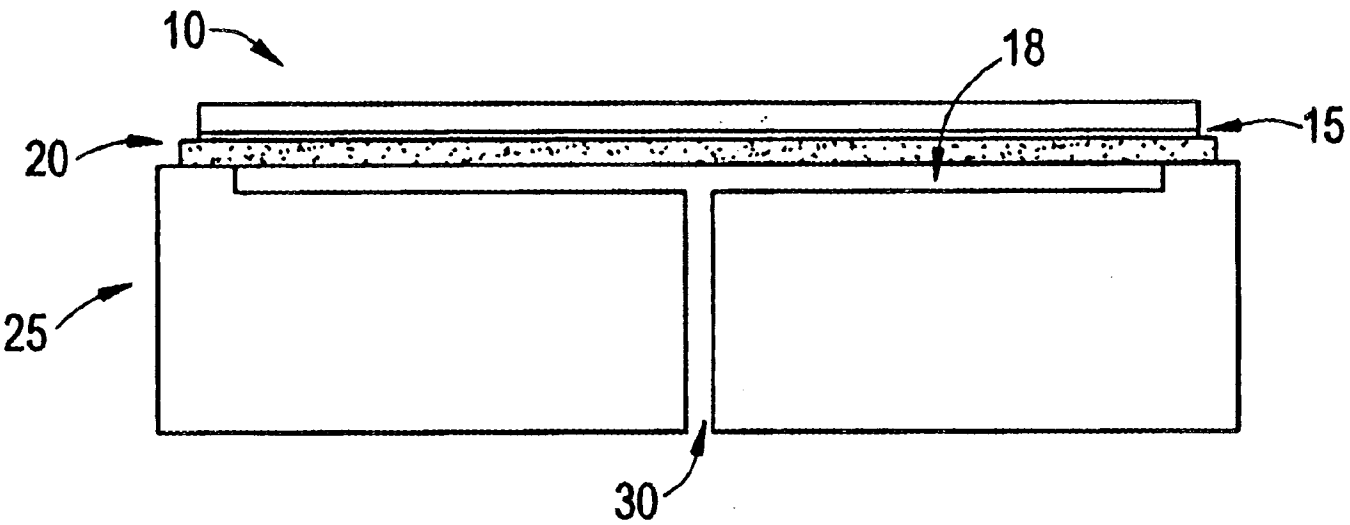
FIG. 3 is a schematic view of a rigid plate assembly according to the principles of the present invention.
Figure 5:
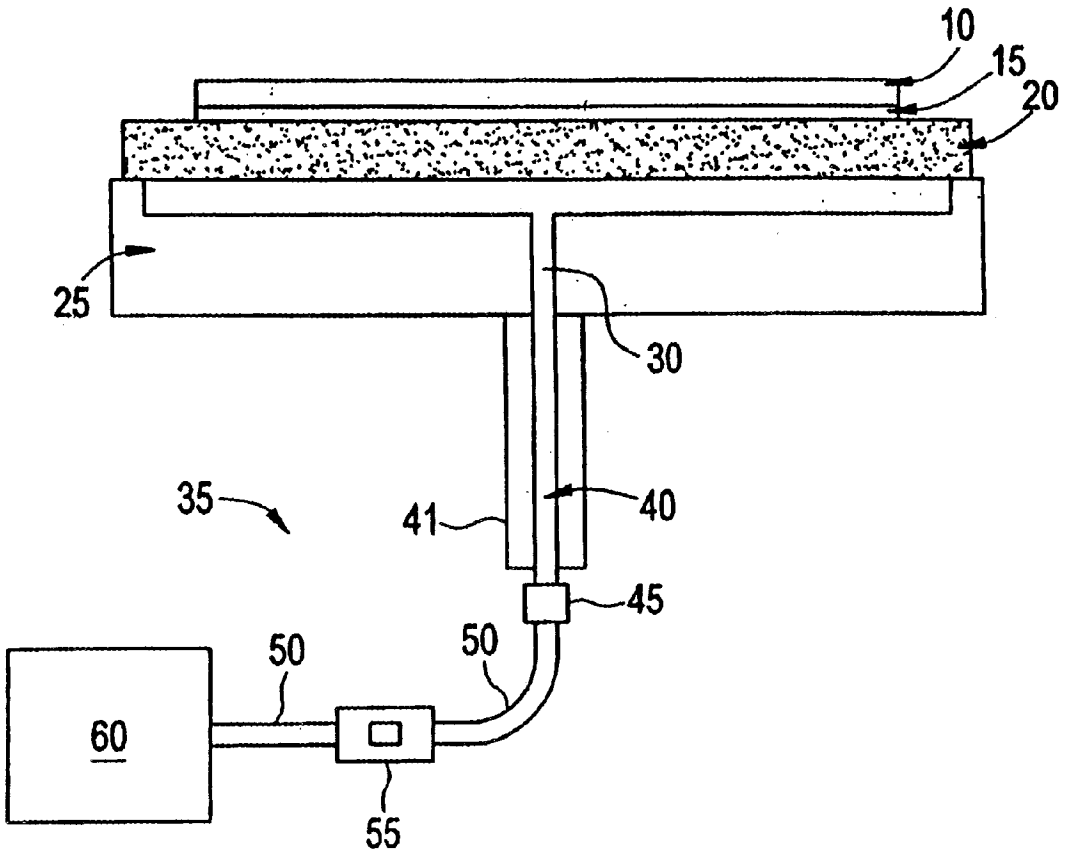
FIG. 5 is a schematic view of the vacuum source according to the principles of the invention.

Referring now to FIGS. 2, 3, and 5, a CMP apparatus in accordance with the principles of the present invention includes a polishing pad (10) attached to a top surface of a rigid plate member (20) via adhesive material (15). This forms a rigid plate assembly (22) wherein the rigid plate assembly is removably mounted to a rotatable platen (25). The rigid plate member also includes a bottom surface (16). A rotatable platen has a planar top surface (17) and a vacuum channel (30). The vacuum channel defines a cavity (18) in the planar top surface of the rotatable platen and is coupled to a vacuum source (35) for evacuating a fluid from the vacuum channel.

Referring now to FIG. 5, the vacuum source (35) includes a vacuum line (40) running inside a support shaft (41) which couples to the vacuum channel (30), a vacuum seal (45), a vacuum hose (50), and a vacuum switch (55). The vacuum line is also coupled to the vacuum hose. The vacuum seal is placed on the connection between the vacuum line and vacuum hose. The vacuum switch is coupled to the vacuum hose. The vacuum switches the vacuum on and off. The vacuum hose is coupled to a vacuum generator (60).

Figure 4:
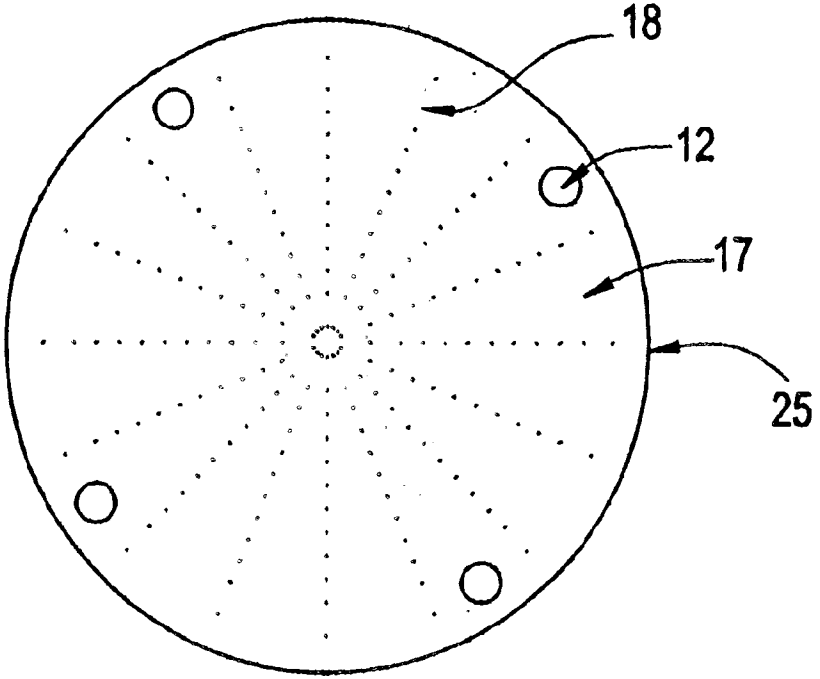
FIG. 4 is a schematic view of the vacuum channel arranged within a rotatable platen according to the principles of the invention.

FIG. 2 shows a three-dimensional blow up view of the rotatable platen (25) having the vacuum channel (30), cavity (18), and the rigid plate assembly (22) (comprised of the polishing pad (10), adhesive (15), and rigid plate member (20)). Different vacuum channel patterns, numbers of vacuum channels, and vacuum channel sizes are contemplated. The vacuum channel pattern used may affect the holding force produced by the vacuum source as well as the uniformity of force across the rigid plate assembly. Referring now to FIG. 4, the vacuum channel (30) may alternatively include a linear series of cavities radiating from the center of the planar top surface (17) of the rotatable platen.

Referring now back to FIG. 2, according to the principles of the present invention, the rigid plate member (20) includes a self-alignment structure such as pin members (21) which protrude from the bottom surface (16) thereof, while the planar top surface (17) of the rotatable platen includes guide openings (12) for receiving the pin members, thus rotatably securing the rigid plate member with respect to the rotatable platen during polishing. In this embodiment, the pin members (21) and the guide openings (12) automatically align the rigid plate assembly with respect to the rotatable platen (25) upon suctioning of the rigid plate assembly (22) onto the rotatable platen (25).

The method for using the CMP apparatus described above will now be explained. A rigid plate assembly (22) with a used polishing pad (10) may be removed from the planar top surface (17) of the rotatable platen (25) by releasing a vacuum within the vacuum channel (30) and lifting the rigid plate assembly from the planar top surface of the rotatable platen. Accordingly, the pin members (21) are removed from the guide openings (12) in the planar top surface of the rotatable platen. The used polishing pad is then removed from the rigid plate member (20). The top surface of the rigid plate member is then cleaned to remove used adhesive (15) that secured the old polishing pad to the top surface. A new polishing pad (10) is then positioned on the top surface and secured in place using new adhesive (15) to form a renewed rigid plate assembly (22). Finally, the rigid plate assembly, including the new polishing pad is positioned on the planar top surface of the rotatable platen.

Positioning the rigid plate assembly (22) onto the planar top surface (17) of the rotatable platen (25) includes locating the pin members (21) into the guide openings (21), thereby securing the rigid plate assembly to the top surface of the rotatable platen.

The rigid plate assembly (22) is positioned on the rotatable platen (25), with the bottom surface (16) of the rigid plate member (20) facing the rotatable platen. A vacuum is then created within the vacuum channel (30) to secure the rigid plate assembly to the planar top surface (17) of the rotatable platen. Once CMP is complete, the vacuum generator (60) can be turned off using the vacuum switch (55) and the rigid plate assembly can be removed from the rotatable platen.

It should be appreciated by those skilled in the art that the method steps described above for replacing a polishing pad in a CMP machine may be carried out by one or more individuals or robotics. In the event that robotics are used, the robotics may be configured to replace used polishing pads automatically, beneficially based upon a wear reading monitored via end point detection systems currently known in the field of art.

While exemplary embodiments of the invention have been shown in the drawings and described, it should be understood that the principles of the present invention are not limited to the specific forms shown or described herein. For example, the removable rigid plate assembly of the present invention may be mounted to either a rotating or a non-rotating platen that may comprise any number of possible shapes. Various modifications may be made in the design, arrangement, and type of elements disclosed herein, as well as the steps of using the invention without departing from the scope of the invention as expressed in the appended claims.

What is claimed is:

1. A rigid plate assembly being receivable on a rotatable platen in a CMP machine, comprising:

a rigid plate member having a top surfaces, a bottom surface and self-alignment structures disposed thereon used to self align the rigid plate assembly receivable on the rotatable platen;

a polishing pad provided on said top surface, thereby forming a rigid plate assembly, wherein said polishing pad is adhesively bonded to said rigid plate member, and wherein said rigid plate assembly is suctioned onto a top surface of a rotatable platen.

2. The rigid plate assembly being receivable on a rotatable platen in a CMP machine, according to claim 1, wherein said rigid plate member includes alignment pins protruding from said bottom surface thereof, said alignment pins being receivable into guide openings formed said rotatable platen.

3. A CMP polishing unit, comprising:

a rigid plate member having a top surface and a bottom surface and self-alignment structures disposed thereon used to self align the rigid plate assembly receivable on the rotatable platen;

a polishing pad provided on said top surface, thereby forming a rigid plate assembly, wherein said polishing pad is adhesively bonded to said rigid plate member, and a rotatable platen having a vacuum channel for asserting a vacuum on said rigid plate member.

4. The rigid plate assembly being receivable on the rotatable platen according to claim 3, wherein at least one vacuum channel is formed within the rotatable platen.

5. The rigid plate assembly being receivable on the rotatable platen according to claim 4, wherein said at least one vacuum channel includes at least one cavity in a top surface of said rotatable platen to allow the rigid plate assembly to be suctioned with a vacuum.

6. The rigid plate assembly being receivable on the rotatable platen according to claim 5, wherein said at least one vacuum channel comprises a single cavity, circular in dimension, having a single diameter greater than at least half of the diameter of the rotatable platen.

7. The rigid plate assembly being receivable on the rotatable platen according to claim 5, wherein said at least one vacuum channel comprises a plurality of cavities, arranged to linearly radiate from the center of the top surface of the rotatable platen.

8. The rigid plate assembly being receivable on the rotatable platen according to claim 4, wherein said at least one vacuum channel is coupled to a source of a releasable vacuum force adapted to act on said bottom surface to bias said rigid plate assembly towards the rotatable platen.

9. The rigid plate assembly being receivable on the rotatable platen according to claim 8, wherein the source of the releasable vacuum force is a vacuum source coupled to a switch for activating and deactivating the vacuum force so that the rigid plate member can be selectively secured onto and removed from the rotatable platen.

10. The rigid plate assembly being receivable on the rotatable platen according to claim 9, wherein the vacuum source comprises a vacuum and a vacuum line, and wherein the vacuum line opens to the at least one vacuum channel and couples the at least one vacuum channel to the vacuum source.

11. The rigid plate assembly being receivable on the rotatable platen according to claim 3, further comprising:

pin members protruding from said bottom surface; and guide openings formed in the top surface of the rotatable platen, wherein said guide openings receive said pin members.

12. A method to use a vacuum to hold a rigid plate assembly to a rotatable platen in a polishing apparatus, comprising:

adhesively arranging a polishing pad on a top surface of a rigid plate member, thereby forming a rigid plate assembly; and suctioning said rigid plate assembly onto a top surface of said rotatable platen wherein said rigid plate assembly automatically aligns with respect to said rotatable platen upon suctioning the rigid plate assembly onto the rotatable platen.

13. The method to use a vacuum to hold a rigid plate assembly to a rotatable platen in a polishing apparatus according to claim 12, further comprising:

forming at least one vacuum channel within the rotatable platen.

14. The method to use a vacuum to hold a rigid plate assembly to a rotatable platen in a polishing apparatus according to claim 13, wherein said at least one vacuum channel is formed by at least one cavity in a top surface of said rotatable platen.

15. The method to use a vacuum to hold a rigid plate assembly to a rotatable platen in a polishing apparatus according to claim 12, further comprising coupling said at least one vacuum channel to a source of a releasable vacuum force adapted to act on said bottom surface to pull said rigid plate assembly towards the rotatable platen.

16. The method to use a vacuum to hold a rigid plate assembly to a rotatable platen in a polishing apparatus according to claim 15, wherein the source of the releasable vacuum force is a vacuum source coupled to a switch for activating and deactivating the vacuum force so that the rigid plate member can be selectively secured onto and removed from the rotatable platen.

17. The method to use a vacuum to hold a rigid plate assembly to a rotatable platen in a polishing apparatus according to claim 15, wherein the vacuum source comprises a vacuum and a vacuum line, and the vacuum line opens to the at least one vacuum channel and couples the at least one vacuum channel to the vacuum.

18. The method to use a vacuum to hold a rigid plate assembly to a rotatable platen in a polishing apparatus according to claim 12, further comprising:

forming pin members protruding from said bottom surface; and forming guide openings within said rotatable platen and opening to the upper surface thereof, wherein said guide openings receive said pin members.

19. The method to use a vacuum to hold a rigid plate assembly to a rotatable platen in a polishing apparatus according to claim 12, wherein said suctioning is performed by asserting a vacuum between said rigid plate member and said rotatable platen.

20. The method to use a vacuum to hold a rigid plate assembly to a rotatable platen in a polishing apparatus according to claim 19, wherein said vacuum is selectively applied.

* * * * *